US007966849B2

(12) United States Patent
Wu

(10) Patent No.: US 7,966,849 B2
(45) Date of Patent: Jun. 28, 2011

(54) SLIDING PADLOCK

(76) Inventor: Kun Yu Wu, Sinjhuang (TW)

( * ) Notice: Subject to any disclaimer, the term of this patent is extended or adjusted under 35 U.S.C. 154(b) by 193 days.

(21) Appl. No.: 12/483,589

(22) Filed: Jun. 12, 2009

(65) Prior Publication Data

US 2010/0313617 A1 Dec. 16, 2010

(51) Int. Cl.
*E05B 67/24* (2006.01)

(52) U.S. Cl. ..... 70/38 R; 70/38 B; 70/52; 70/53

(58) Field of Classification Search ..... 70/20, 31, 70/35, 38 R, 38 B, 38 C, 39, 52, 53
See application file for complete search history.

(56) References Cited

U.S. PATENT DOCUMENTS

| | | | | | |
|---|---|---|---|---|---|
| 208,123 | A * | 9/1878 | Roberts | 70/38 C |
| 459,499 | A * | 9/1891 | Moore | 70/38 R |
| 839,795 | A * | 12/1906 | Wilcox | 70/28 |
| 1,452,393 | A * | 4/1923 | Shek | 70/38 C |
| 1,477,777 | A * | 12/1923 | Shek | 70/38 C |
| 1,622,999 | A * | 3/1927 | Frith | 70/38 A |
| 2,116,965 | A * | 5/1938 | Schoorel et al. | 70/38 A |
| 4,838,051 | A | 6/1989 | Yang | |
| 5,133,203 | A | 7/1992 | Huang | |
| 5,447,049 | A | 9/1995 | Shieh | |
| 5,720,191 | A | 2/1998 | Tsung-Chuan et al. | |
| 6,523,378 | B2 | 2/2003 | Kuo | |
| 6,904,775 | B2 | 6/2005 | Makos et al. | |
| 7,171,833 | B1 | 2/2007 | Wu | |
| 7,370,892 | B2 | 5/2008 | Collingham | |
| 7,555,925 | B1 | 7/2009 | Wu | |
| 7,571,627 | B2 * | 8/2009 | Yu | 70/21 |
| 2006/0179899 | A1 | 8/2006 | Yu | |
| 2008/0223088 | A1 | 9/2008 | Yang | |
| 2008/0282753 | A1 | 11/2008 | Hecht et al. | |

* cited by examiner

*Primary Examiner* — Lloyd A Gall
(74) *Attorney, Agent, or Firm* — C. G. Mersereau; Nikolai & Mersereau, P.A.

(57) ABSTRACT

A sliding padlock has a shell, a locking assembly, a shackle and a resilient element. The locking assembly is mounted in the shell and has a lock cylinder and a lock rod. The shackle is mounted in a locking end of the shell, is selectively blocked by the lock rod and abuts the resilient element. Because of the resilient element, the shackle is held to abut the shell without external force even when the lock cylinder is unlocked. Therefore, the sliding padlock still holds an object in position when unlocked so a user may take the object easily without using a key.

15 Claims, 9 Drawing Sheets

SLIDING PADLOCK

BACKGROUND OF THE INVENTION

1. Field of the Invention

The present invention relates to a sliding padlock, especially to a small sliding padlock that remains effective for theft prevention and can be carried easily.

2. Description of the Prior Arts

Padlocks are widely used, especially for locking trunks, bicycles, etc. A conventional padlock comprises a shell, a shackle and a lock cylinder. The shackle has a connecting end and a distal end. The connecting end of the shackle is mounted rotatably in the shell. The lock cylinder is mounted in the shell. When the lock cylinder is locked, the distal end of the shackle is held in the shell to hold the objects. When the lock cylinder is unlocked, the distal end of the shackle is pushed out of the shell to release the objects.

However, the conventional padlock only allows hooking two objects together when the lock cylinder is locked. When two objects are hooked together by the conventional padlock, a certain key needs to be inserted to release the objects. Therefore, hooking objects together temporarily by the conventional padlock is inconvenient since a certain key is always needed to release the objects.

To overcome the shortcomings, the present invention provides a sliding padlock to mitigate or obviate the aforementioned problems.

SUMMARY OF THE INVENTION

The main objective of the present invention is to provide a sliding padlock that still holds the object in position even when the lock cylinder is unlocked. The sliding padlock has a shell, a locking assembly, a shackle and a resilient element. The locking assembly is mounted in the shell and has a lock cylinder and a lock rod. The shackle is mounted in a slide channel of the shell, is selectively blocked by the lock rod and abuts the resilient element. Because of the resilient element, the shackle is held to abut the shell without external force even when the lock cylinder is unlocked. Therefore, the sliding padlock still holds an object in position when unlocked so a user may take the object easily without using a key.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
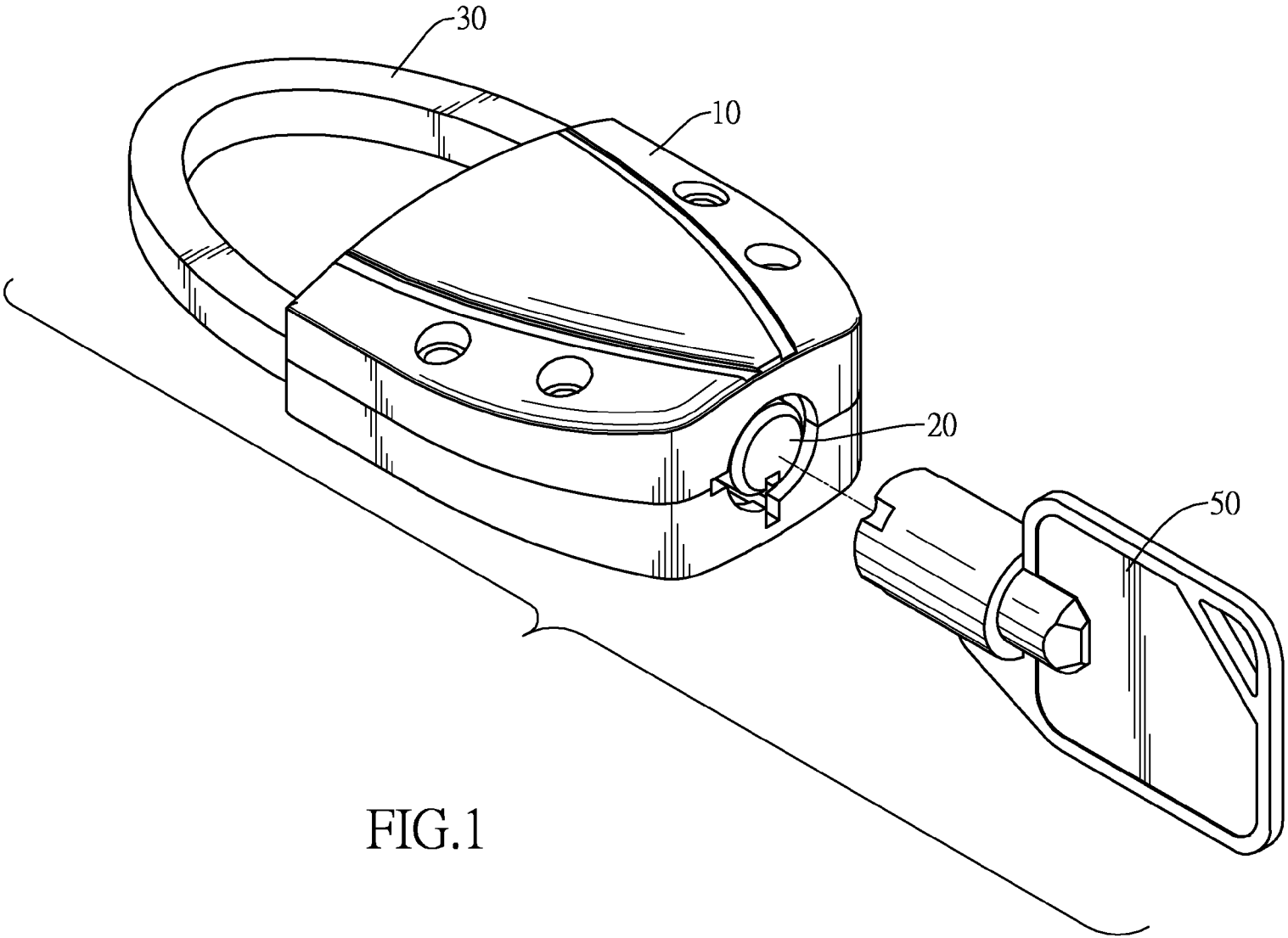
FIG. 1 is a perspective view of a sliding padlock in accordance with the present invention with a key.
Figure 2:
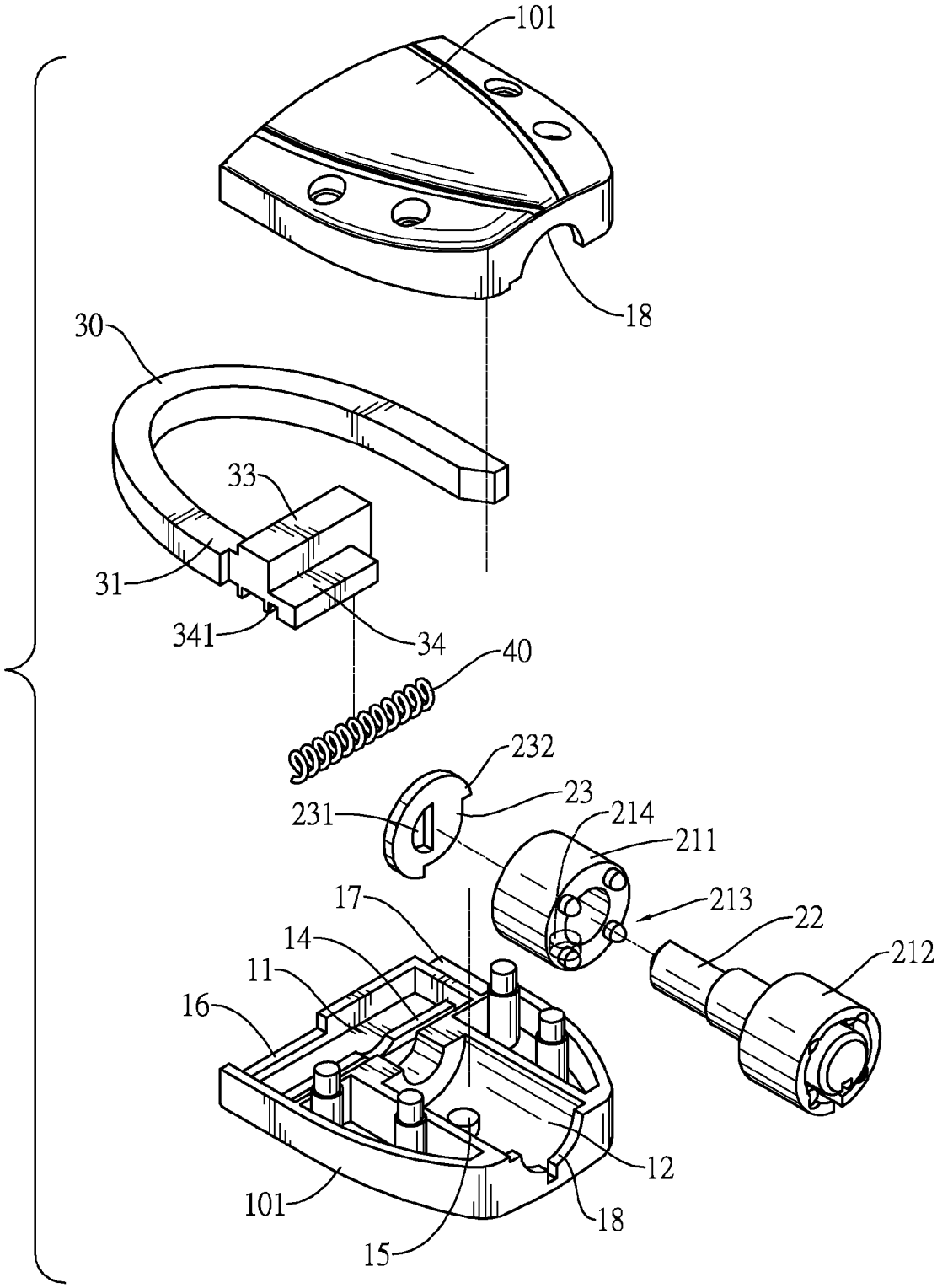
FIG. 2 is an exploded perspective view of the sliding padlock in FIG. 1.
Figure 3:
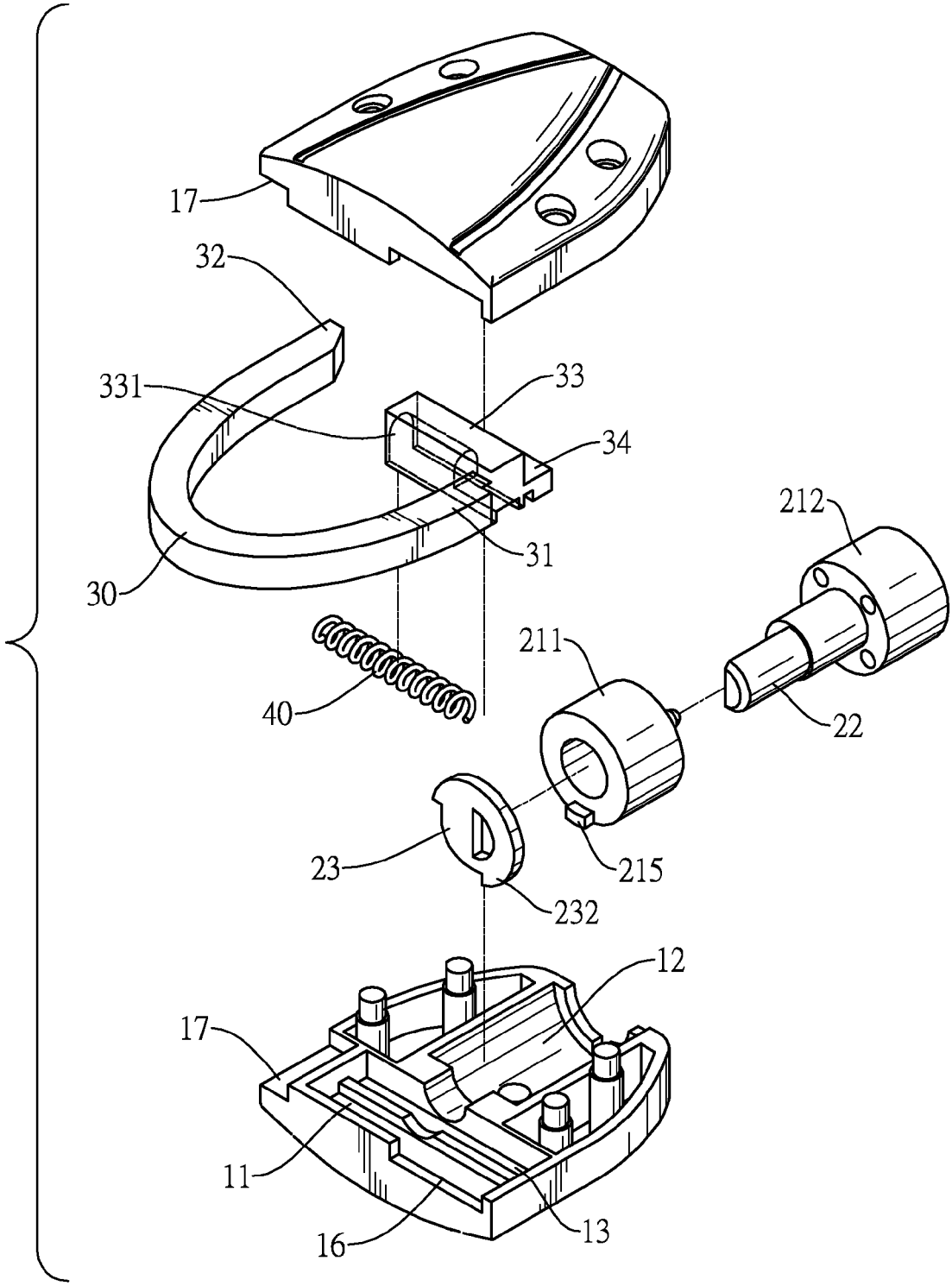
FIG. 3 is another exploded perspective view of the sliding padlock in FIG. 1.

With reference to FIGS. 1 to 3, a sliding padlock in accordance with the present invention comprises a shell (10), a locking assembly (20), a shackle (30) and a resilient element (40).

The shell (10) may comprise two half-shells (101) being attached to each other. The shell (10) has a locking end, a key end, an inside wall, an outside wall, a slide chamber (11), a lock chamber (12), a guide channel (13), a rib (14), a protrusion (15), a guiding slot (16), a mounting recess (17) and an opening (18). The slide chamber (11) is formed in the shell (10) adjacent to the locking end. The lock chamber (12) is formed in the shell (10) adjacent to the key end. The guide channel (13) is formed in the shell (10) and is formed between and communicates with the slide and lock chambers (11, 12). The rib (14) is formed on the inside wall between the slide chamber and guide channel (11, 13). The protrusion (15) is formed on the inside wall in the lock chamber (12). The guiding slot (16) is formed through the locking end and communicates with the slide chamber (11). The mounting recess (17) is formed in the outside wall adjacent to the locking end. The opening (18) is formed through the key end and communicates with the lock chamber (12).

The locking assembly (20) is mounted in the shell (10) and has a lock cylinder, a lock rod (22) and a limiting washer (23).

The lock cylinder is mounted in the lock chamber (12) of the shell (10), corresponds to the opening (18) of the shell (10) and may be a combination lock, tumbler lock, or the like. In the preferred embodiment, the lock cylinder comprises a front sleeve (211), a rear sleeve (212) and a lock pin assembly (213). The front sleeve (211) is mounted securely in the lock chamber (12) and has a fastening hole (214) engaging the protrusion (15) of the shell (10). The rear sleeve (212) is mounted rotatably in the lock chamber (12) adjacent to the opening (18) and abuts the front sleeve (211). The lock pin assembly (213) is mounted through the front and rear sleeves (211, 212) to selectively prevent rotation of the rear sleeve (212). When a certain key (50) is inserted to unlock the lock cylinder, the lock pin assembly (213) is pushed and the rear sleeve (212) is allowed to rotate relative to the front sleeve (211). When the certain key (50) is removed, the lock pin assembly (213) is released and the rear sleeve (212) is held to be non-rotatable so that the lock cylinder is locked. Detailed operation and structure of the lock cylinder is well known in the art so no detailed discussion is disclosed.

The lock rod (22) is connected eccentrically to the lock cylinder and protrudes into the guide channel (13) of the shell (10). When the lock cylinder is unlocked, the lock rod (22) is rotatable to alternatively protrude across a top and a bottom of the guide channel (13) of the shell (10) or protrude in only the top of the guide channel (13) of the shell (10). In a preferred embodiment, the lock rod (22) is semicircular in cross section, is connected eccentrically to an end of the rear sleeve (212) and protrudes through the front sleeve (211). The lock rod (22) may be mounted on or be formed on the end of the rear sleeve (212).

The limiting washer (23) is mounted securely around the lock rod (22) and has an annular edge, a through hole (231) and a limit (232). The through hole (231) may be semicircular to engage the semicircular lock rod (22). The limit (232) is formed on and extends out from the annular edge of the limiting washer (23). A stop (215) is formed on the lock cylinder and selectively abuts the limit (232) to limit the rotating angle of the limiting washer (23) and the lock rod (22). The stop (215) may be formed on an end of the front sleeve (211).

The shackle (30) is U-shaped, is mounted through the locking end of the shell (10) and has a connecting end (31), a free end (32), a protruding segment (33) and an actuating segment (34). The connecting end (31) is mounted slidably through the guiding slot (16) of the shell (10). The free end (32) is selectively received in the mounting recess (17) of the shell (10). The protruding segment (33) is formed on the connecting end (31), is mounted slidably in the slide chamber (11) of the shell (10) and has a rear surface, a bottom surface and a mounting channel (331). The mounting channel (331) is formed in the bottom surface of the protruding segment (33). The actuating segment (34) is formed on the rear surface of the protruding segment (33), is mounted slidably in the bottom of the guide channel (13) of the shell (10), selectively abuts the lock rod (22) and has a sliding path, a bottom surface and a sliding channel (341). The sliding path of the actuating segment (34) is selectively blocked by the lock rod (22). In the preferred embodiment, the sliding path of the actuating segment (34) is the guide channel (13) of the shell (10). When the lock rod (22) is disposed across the top and the bottom of the guide channel (13) of the shell (10), the lock rod (22) blocks the sliding path of the actuating segment (34). When the lock rod (22) is only disposed in the top of the guide channel (13) of the shell (10), the lock rod (22) allows the actuating segment (34) to pass along the sliding path. The sliding channel (341) is formed in the bottom surface of the actuating segment (34) and is mounted slidably around the rib (14) of the shell (10) to limit the sliding path of the shackle (30). The actuating segment (34) may be thinner than the protruding segment (33).

The resilient element (40) is mounted in the slide chamber (11) of the shell (10), presses against the inside wall of the shell (10) and the shackle (30) and may be mounted in the mounting channel (331) of the protruding segment (33) of the shackle (30).

At least one object is put between the shackle (30) and the shell (10) to be held in position via the free end (32) of the shackle (30) received in the mounting recess (17) of the shell (10).

Figure 4:
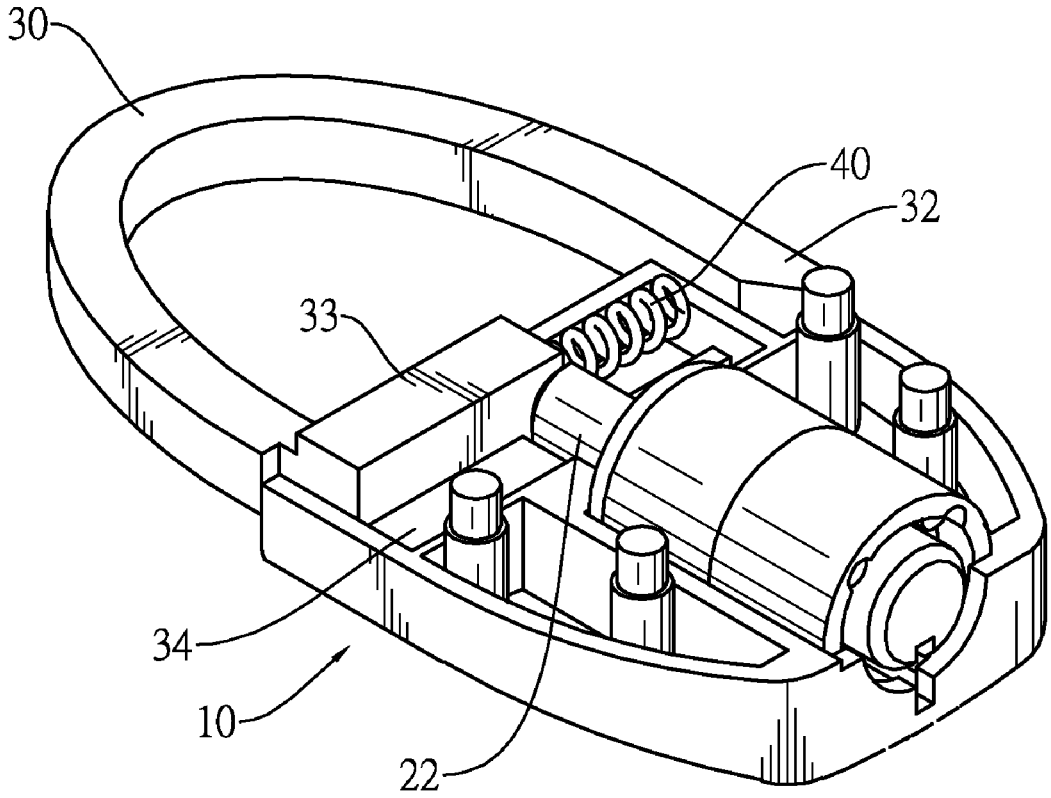
FIG. 4 is a perspective view of the sliding padlock in FIG. 1 without one half-shell.
Figure 5:
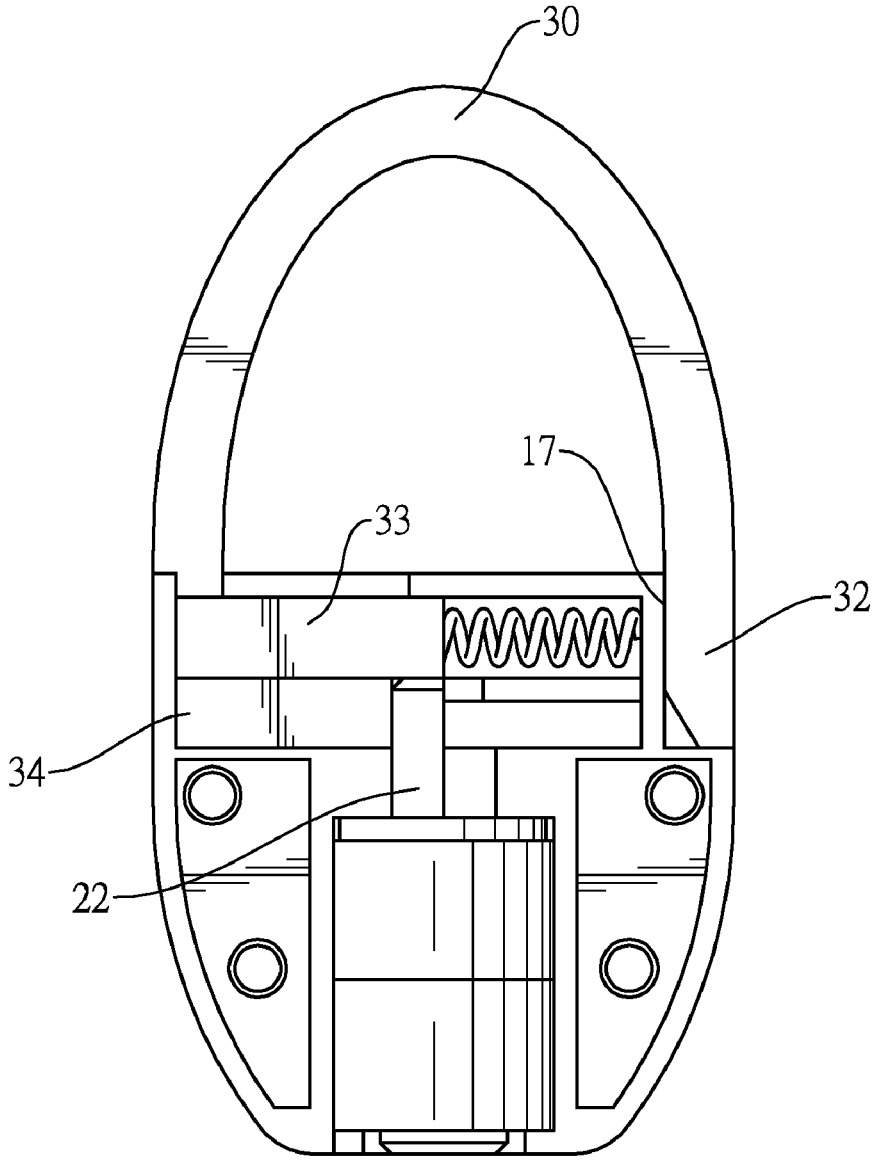
FIG. 5 is a front view of the sliding padlock in FIG. 1 without the half-shell.

With reference to FIGS. 4 and 5, when the lock rod (22) blocks the sliding path of the actuating segment (34) of the shackle (30), the shackle (30) cannot slide.

Figure 6:
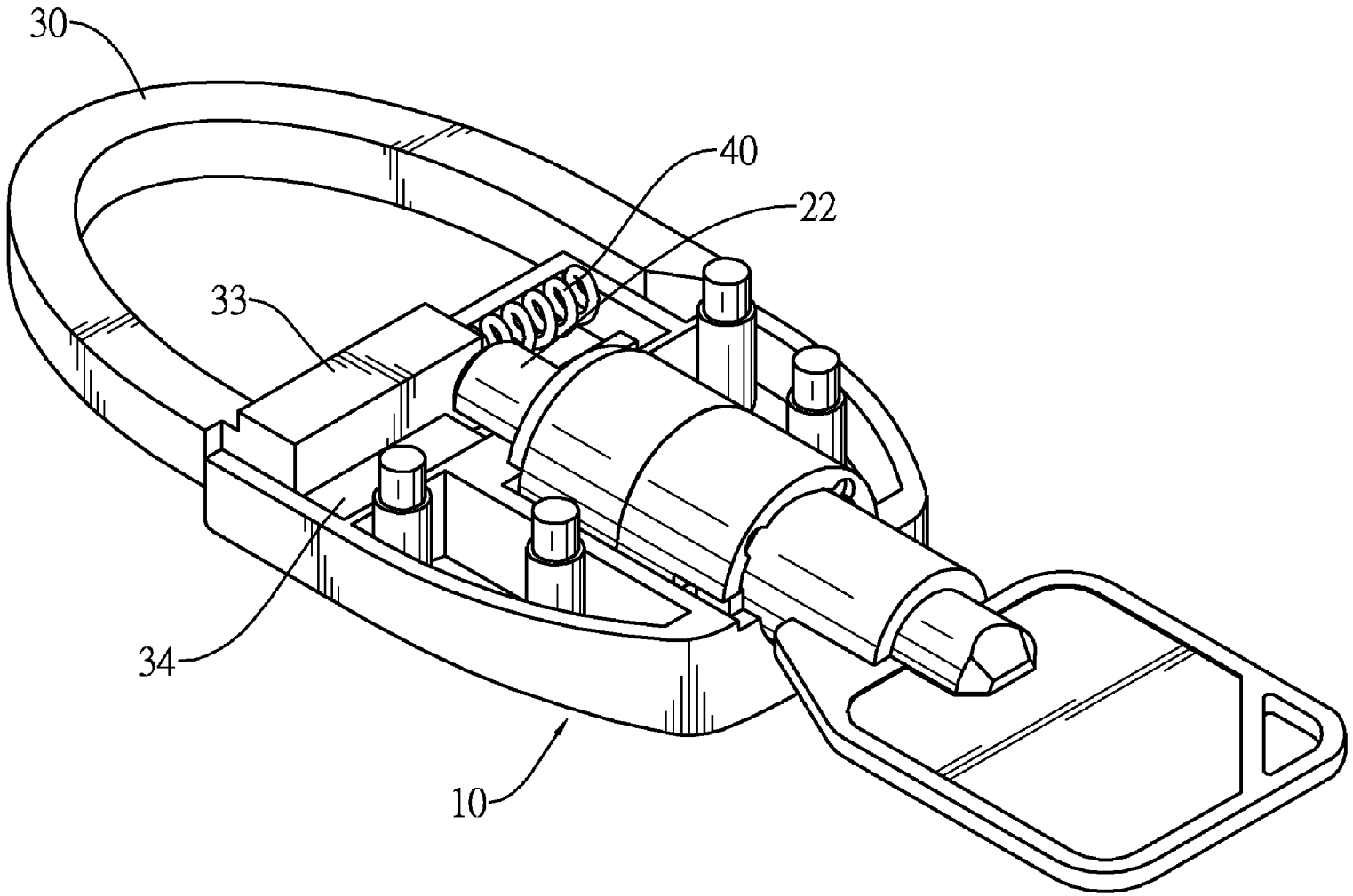
FIG. 6 is an operational perspective view of the sliding padlock in FIG. 4, showing the key unlocking the lock cylinder.
Figure 7:
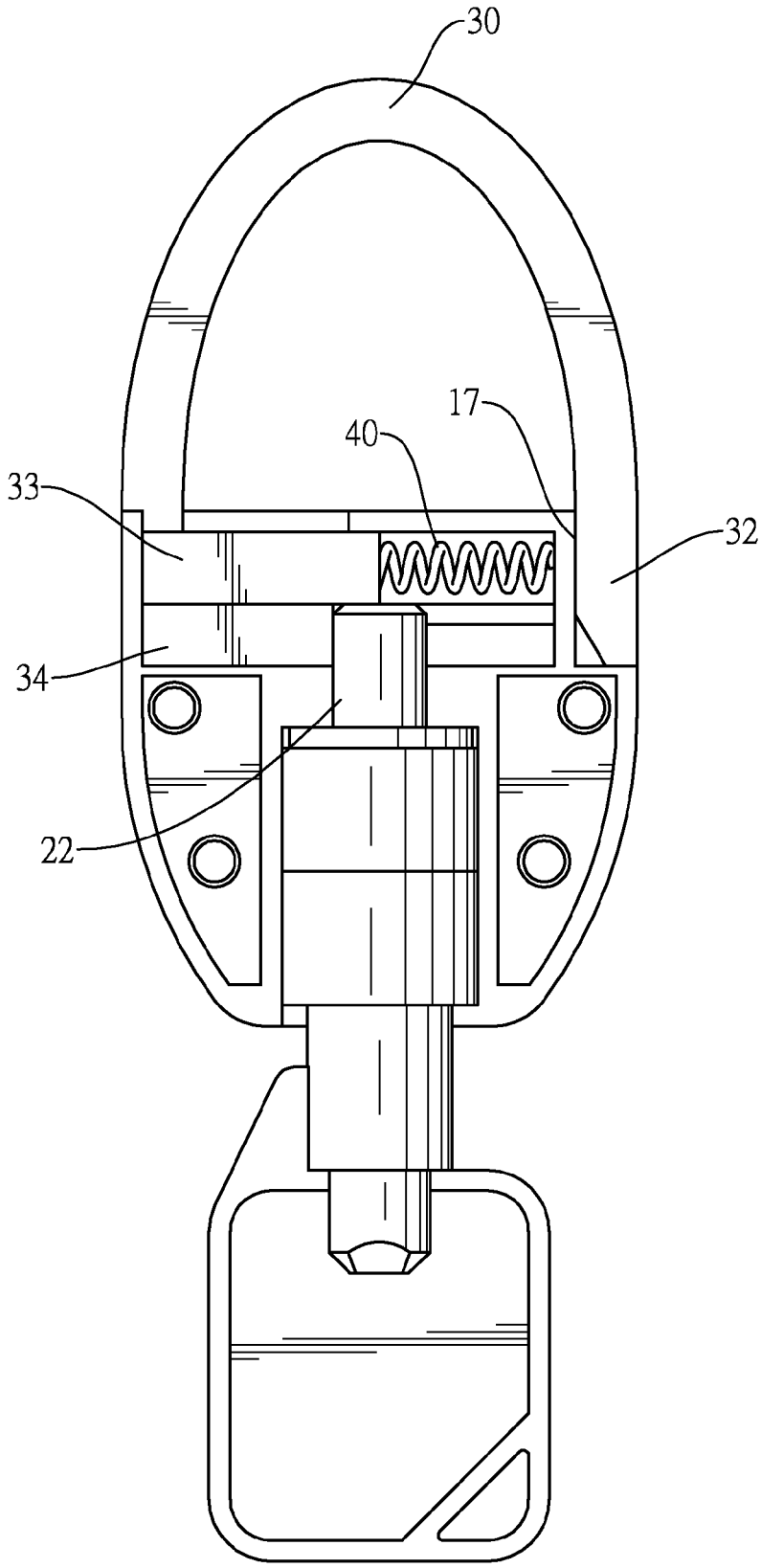
FIG. 7 is an operational top view of the sliding padlock in FIG. 4, showing the key unlocking the lock cylinder.

With reference to FIGS. 6 and 7, the certain key (50) is inserted to unlock the lock cylinder to allow the lock rod (22) rotatable and open the sliding path of the actuating segment (34). Then the shackle (30) is allowed to slide. However, the resilient element (40) presses the protruding segment (33) of the shackle (30) to hold the free end (32) in the mounting recess (17) of the shell (10). Thus, the object is still held in position even when the lock cylinder is unlocked.

Figure 8:
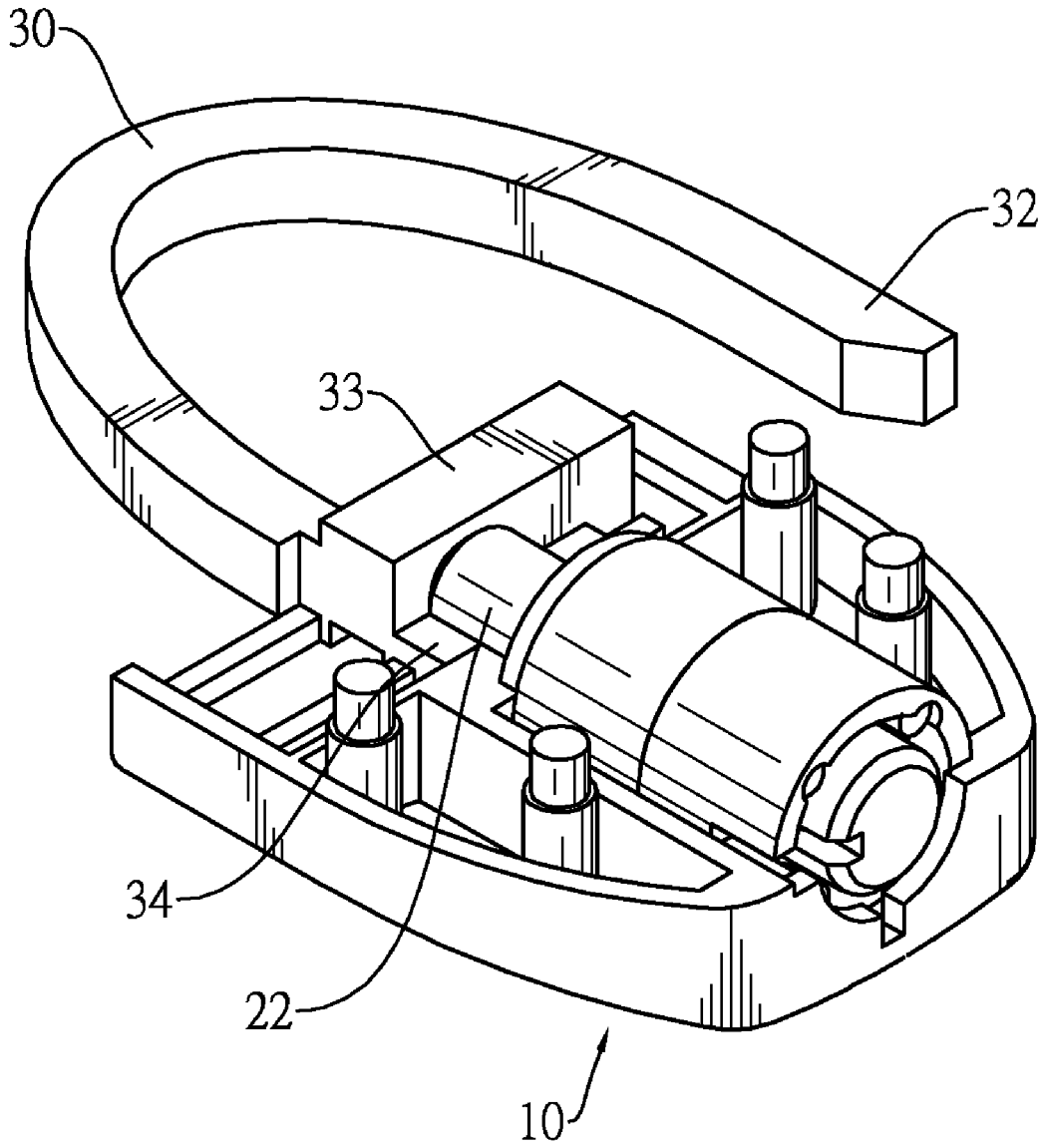
FIG. 8 is an operational perspective view of the sliding padlock in FIG. 4, showing the shackle being slid.
Figure 9:
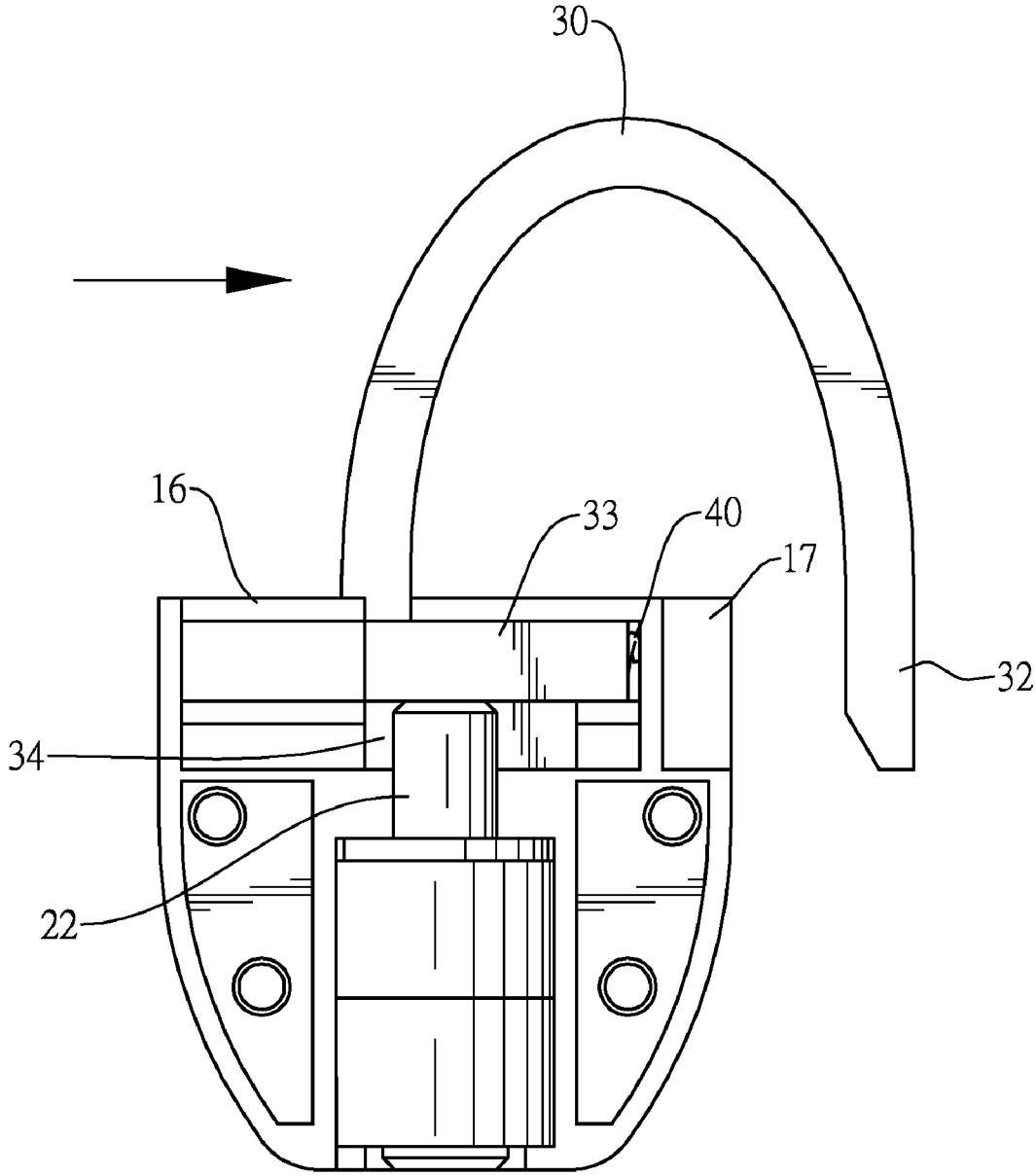
FIG. 9 is an operational front view of the sliding padlock in FIG. 4, showing the shackle being slid.

With reference to FIGS. 8 and 9, the shackle (30) is slid and the protruding segment (33) presses the resilient element (40). Then the free end (32) leaves the mounting recess (17) of the shell (10) to release the object.

The sliding padlock as described has a following advantage. Because the resilient element (40) presses the shackle (30), the free end (32) of the shackle (30) is held in the mounting recess (17) without any other external force. Therefore, the user may temporally lock the object in place without locking the lock cylinder, and may also easily unlock the object by pushing the shackle (30) without using a certain key.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A sliding padlock comprising:

a shell having
- a locking end;
- a key end;
- an inside wall;
- an outside wall;
- a slide chamber being formed in the shell adjacent to the locking end;
- a lock chamber being formed in the shell adjacent to the key end;
- a guide channel being formed in the shell and being formed between and communicating with the slide and lock chambers;
- a guiding slot being formed through the locking end and communicates with the slide chamber;
- a mounting recess being formed in the outside wall adjacent to the locking end; and
- an opening being formed through the key end and communicating with the lock chamber;

a locking assembly being mounted in the shell and having
- a lock cylinder being mounted in the lock chamber of the shell and corresponding to the opening of the shell; and
- a lock rod being connected eccentrically to the lock cylinder and protruding into the guide channel of the shell, wherein when the lock cylinder is unlocked, the lock rod is rotatable;

a shackle being mounted through the locking end of the shell and having
- a connecting end being mounted slidably through the guiding slot of the shell;
- a free end being selectively received in the mounting recess of the shell;
- a protruding segment being formed on the connecting end, being mounted slidably in the slide chamber of the shell and having a rear surface; and
- an actuating segment being formed on the rear surface of the protruding segment, being mounted slidably in the bottom of the guide channel of the shell, selectively abutting the lock rod and having a sliding path selectively being blocked by the lock rod; and a resilient element being mounted in the slide chamber of the shell and being pressed against the inside wall of the shell.

2. The sliding padlock as claimed in claim 1, wherein the lock rod alternatively protrudes across both a top and a bottom of the slide channel of the shell or protrudes in only the top of the middle room of the shell; and the sliding path of the actuating segment is in the bottom of the guide channel of the shell.

3. The sliding padlock as claimed in claim 2, wherein the actuating segment of the shackle is thinner than the protruding segment of the shackle.

4. The sliding padlock as claimed in claim 1, wherein the locking assembly has a limiting washer being mounted securely around the lock rod and having
- an annular edge; and
- a limit being formed on and extending out from the annular edge of the limiting washer; and a stop is formed on the lock cylinder and selectively abuts the limit.

5. The sliding padlock as claimed in claim 3, wherein the locking assembly has a limiting washer being mounted securely around the lock rod and having an annular edge; and a limit being formed on and extending out from the annular edge of the limiting washer; and a stop is formed on the lock cylinder and selectively abuts the limit.

6. The sliding padlock as claimed in claim 5, wherein the lock rod is semicircular in cross section; and the limiting washer has a semicircular through hole to engage the semicircular lock rod.

7. The sliding padlock as claimed in claim 1, wherein the lock cylinder has a front sleeve being mounted securely in the lock chamber of the shell;

a rear sleeve being mounted rotatably in the lock chamber adjacent to the opening of the shell and abutting the front sleeve; and a lock pin assembly being mounted through the front and rear sleeves to selectively keep the rear sleeve from being rotatable; and the lock rod is connected eccentrically to an end of the rear sleeve and protruding through the front sleeve.

8. The sliding padlock as claimed in claim 6, wherein the lock cylinder has a front sleeve being mounted securely in the lock chamber of the shell;

a rear sleeve being mounted rotatably in the lock chamber adjacent to the opening of the shell and abutting the front sleeve; and a lock pin assembly being mounted through the front and rear sleeves to selectively prevent rotation of the rear sleeve;

the lock rod is connected eccentrically to an end of the rear sleeve and protruding through the front sleeve; and the stop is formed on an end of the front sleeve.

9. The sliding padlock as claimed in claim 8, wherein the lock rod is formed on the end of the rear sleeve.

10. The sliding padlock as claimed in claim 1, wherein the protruding segment of the shackle has a bottom surface; and a mounting channel being formed in the bottom surface of the protruding segment; and the resilient element is mounted in the mounting channel of the protruding segment of the shackle.

11. The sliding padlock as claimed in claim 9, wherein the protruding segment of the shackle has a bottom surface; and a mounting channel being formed in the bottom surface of the protruding segment; and the resilient element is mounted in the mounting channel of the protruding segment of the shackle.

12. The sliding padlock as claimed in claim 1, wherein the shell has a rib being formed on the inside wall between the slide chamber and guide channel; and the actuating segment of the shackle has a bottom surface; and a sliding channel being formed in the bottom surface of the actuating segment and being mounted slidably around the rib of the shell.

13. The sliding padlock as claimed in claim 11, wherein the shell has a rib being formed on the inside wall between the slide chamber and guide channel; and the actuating segment of the shackle has a bottom surface; and a sliding channel being formed in the bottom surface of the actuating segment and being mounted slidably around the rib of the shell.

14. The sliding padlock as claimed in claim 1, wherein the shell has a protrusion being formed on the inside wall in the lock chamber; and a front sleeve of the lock cylinder has a fastening hole engaging the protrusion of the shell.

15. The sliding padlock as claimed in claim 13, wherein the shell has a protrusion being formed on the inside wall in the lock chamber; and the front sleeve of the lock cylinder has a fastening hole engaging the protrusion of the shell.

* * * * *